US008864263B2

(12) United States Patent
Kubo et al.

(10) Patent No.: US 8,864,263 B2
(45) Date of Patent: Oct. 21, 2014

(54) INKJET RECORDING DEVICE AND METHOD FOR GENERATING DRIVE WAVEFORM SIGNAL

(75) Inventors: Naomi Kubo, Hino (JP); Yoshifumi Takafuji, Kodaira (JP); Eisuke Takagi, Kawasaki (JP)

(73) Assignee: Konica Minolta, Inc. (JP)

( * ) Notice: Subject to any disclaimer, the term of this patent is extended or adjusted under 35 U.S.C. 154(b) by 0 days.

(21) Appl. No.: 13/994,984

(22) PCT Filed: Dec. 7, 2011

(86) PCT No.: PCT/JP2011/078320

§ 371 (c)(1),
(2), (4) Date: Jun. 17, 2013

(87) PCT Pub. No.: WO2012/081472

PCT Pub. Date: Jun. 21, 2012

(65) Prior Publication Data

US 2013/0271519 A1 Oct. 17, 2013

(30) Foreign Application Priority Data

Dec. 16, 2010 (JP) ..... 2010-280414

(51) Int. Cl.
*B41J 29/38* (2006.01)
*B41J 2/045* (2006.01)

(52) U.S. Cl.
CPC ..... *B41J 2/04588* (2013.01); *B41J 2202/18* (2013.01); *B41J 2/04581* (2013.01); *B41J 2/04596* (2013.01)
USPC ..... 347/10

(58) Field of Classification Search
CPC ..... B41J 2/04588; B41J 2/04591; B41J 2/04595; B41J 2/04596
USPC ..... 347/10, 9, 11
See application file for complete search history.

(56) References Cited

U.S. PATENT DOCUMENTS 5,202,659 A 4/1993 DeBonte et al.
2004/0155915 A1* 8/2004 Kitami et al. ..... 347/10

(Continued)

FOREIGN PATENT DOCUMENTS

JP 61-22959 A 1/1986
JP 1-130949 A 5/1989

(Continued)

OTHER PUBLICATIONS

PCT International Preliminary Report on Patentability and Written Opinion for International Application No. PCT/JP2011/078320; Date of Mailing: Jun. 25, 2013; 11 pgs. W/English Translation.

(Continued)

*Primary Examiner* — Stephen Meier
*Assistant Examiner* — Sharon A Polk
(74) *Attorney, Agent, or Firm* — Cantor Colburn LLP

(57) ABSTRACT

An inkjet recording device is configured to cause a head control substrate to generate a first drive waveform signal and a second drive waveform signal. The first drive waveform signal is for applying, after 2 AL from finishing time of an ejection pulse P1 having a voltage V1 and a pulse width AL, a cancel pulse C1 having a voltage V3 (<V1) of the same polarity as the ejection pulse to a head. The second drive waveform signal is for applying, from finishing time of an ejection pulse P12 following an ejection pulse P11 each having a voltage V1 and a pulse width AL, a cancel pulse C11 having a voltage V2 (<V1) of the same polarity as the ejection pulses to the head.

8 Claims, 15 Drawing Sheets

(56) References Cited

U.S. PATENT DOCUMENTS

| | | | | |
|---|---|---|---|---|
| 2006/0082607 | A1* | 4/2006 | Takahashi | 347/10 |
| 2010/0118073 | A1* | 5/2010 | Kitami et al. | 347/10 |

FOREIGN PATENT DOCUMENTS

| | | | |
|---|---|---|---|
| JP | 2006-346936 | A | 12/2006 |
| JP | 2007-22073 | A | 2/2007 |
| JP | 2010-208225 | A | 9/2010 |

OTHER PUBLICATIONS

International Search Report for International Application No. PCT/JP2011/078320, mailed Jan. 17, 2012, with English translation.

* cited by examiner

FIG. 7A

*i; 5cp*

| V1* | V2* | V3* | JUDGMENT | NOTE |
|---|---|---|---|---|
| 1 | 0 | 0 | NG (NOT GOOD) | COMPARATIVE EXAMPLE |
| 1 | 0.68~ | any | F (FAIR) | PRESENT INVENTION |
| 1 | any | 0.34~ | F (FAIR) | PRESENT INVENTION |
| 1 | 0.42~0.67 | 0.33 | G (GOOD) | PRESENT INVENTION |
| 1 | ~0.41 | any | F (FAIR) | PRESENT INVENTION |
| 1 | any | ~0.32 | F (FAIR) | PRESENT INVENTION |

FIG. 7B

*ii; 10cp*

| V1* | V2* | V3* | JUDGMENT | NOTE |
|---|---|---|---|---|
| 1 | 0 | 0 | NG (NOT GOOD) | COMPARATIVE EXAMPLE |
| 1 | 0.51~ | any | F (FAIR) | PRESENT INVENTION |
| 1 | any | 0.45~ | F (FAIR) | PRESENT INVENTION |
| 1 | 0.45~0.5 | 0.19~0.44 | G (GOOD) | PRESENT INVENTION |
| 1 | ~0.44 | any | F (FAIR) | PRESENT INVENTION |
| 1 | any | ~0.18 | F (FAIR) | PRESENT INVENTION |

FIG. 7C

*iii; 15cp*

| V1* | V2* | V3* | JUDGMENT | NOTE |
|---|---|---|---|---|
| 1 | 0 | 0 | NG (NOT GOOD) | COMPARATIVE EXAMPLE |
| 1 | 0.41~ | any | F (FAIR) | PRESENT INVENTION |
| 1 | any | 0.31~ | F (FAIR) | PRESENT INVENTION |
| 1 | 0.3~0.4 | 0.2~0.3 | G (GOOD) | PRESENT INVENTION |
| 1 | ~0.29 | any | F (FAIR) | PRESENT INVENTION |
| 1 | any | ~0.19 | F (FAIR) | PRESENT INVENTION |

INKJET RECORDING DEVICE AND METHOD FOR GENERATING DRIVE WAVEFORM SIGNAL

This is the U.S. national stage of application No. PCT/JP2011/078320, filed on 7 Dec. 2011. Priority under 35 U.S.C. §119(a) and 35 U.S.C. §365(b) is claimed from Japanese Application No. 2010-280414, filed 16 Dec. 2010, the disclosure of which is also incorporated herein by reference.

TECHNICAL FIELD

The present invention relates to an inkjet recording device and a method for generating a drive waveform signal.

BACKGROUND ART

These days, in order to achieve a print speed of 1 m/s and a print resolution of 1200 dpi, an inkjet recording device which is provided with a recording head for ejecting ink droplets drives the recording head by using a 100 kHz binary drive system which uses a drive frequency of 100 kHz (a pixel period of 10 us) and ejects zero or one ink droplet in one pixel period.

The 100 kHz binary drive system drives the recording head according to a drive waveform signal which includes, in one pixel period, an ejection pulse for ejecting one ink droplet and a cancel pulse for suppressing influence of reverberating vibration generated by the ejection pulse in a pressure chamber on a pressure wave therein.

FIG. 12*i*; shows a drive waveform signal in the 100 kHz binary drive system for ejecting ink droplets by a pull-push method, and FIG. 12*ii*; shows a pressure waveform in a pressure chamber generated by a pressure generation unit such as a piezoelectric element that applies pressure to ink according to the drive waveform signal. The voltage V0 represents a standby voltage in the pull-push method. In FIG. 12*ii*, time T1 and time T2 each indicate the time when an ink droplet is ejected (the time at which positive pressure becomes the maximum), the time T1 and the time T2 being the time after an ejection pulse P1 is applied and the time after an ejection P2 is applied, respectively. The ejection pulses P1 and P2 are each for ejecting an ink droplet. A solid line therein represents a pressure waveform in a case where a cancel pulse C1 is applied, and a dashed line therein represents a pressure waveform in a case where the cancel pulse C1 is not applied. In other words, as shown in FIG. 12*ii*, influence of reverberating vibration caused by the ejection pulse P1 is eased by the application of the cancel pulse C1, which reduces a positive pressure at time T2 to approximately the same as that at time T1. Accordingly, ejection speed of an ink droplet ejected on the basis of the ejection pulse P2 can be made the same as that of an ink droplet ejected on the basis of the ejection pulse P1.

Incidentally, the pixel period in the above case requires at least 4 AL when, as shown in FIG. 12*i*, the pulse width of each of the ejection pulse P1 and the cancel pulse C1 is AL (AL: Acoustic Length, i.e., a half period of a natural oscillation period of the pressure chamber), the cancel pulse C1 is applied after AL from the finishing time of the ejection pulse, and an interval after the application of the cancel pulse C1 is finished until the ejection pulse P2 in the next pixel period is applied is AL. Accordingly, in order to achieve the 100 kHz binary drive system (i.e., to make the drive frequency of the recording head reach 100 kHz), the natural oscillation period of the pressure chamber must be 5 us or less (the natural frequency must be 200 kHz or more).

The pulse width is the time from the start of falling of a pulse to the start of rising of the pulse or the time from the start of rising of a pulse to the start of falling of the pulse. For example, in the case shown in FIG. 13, each of a width T1 and a width T3 corresponds to the pulse width.

In consideration of the above, there is a method for driving a recording head by using a 50 kHz 2 dpd drive system which uses a frequency of 50 kHz (a pixel period of 20 us) and ejects zero to two ink droplets in one pixel period.

For example, as an inkjet recording device using the 2 dpd drive system, one is known which can efficiently and stably eject ink at high speed by synchronizing the pulse width of each ejection pulse with the natural oscillation period of a pressure chamber (refer to Patent Literature 1).

PRIOR ART DOCUMENTS

Patent Documents

Patent Literature 1: Japanese Unexamined Patent Application Publication No. S61-22959

SUMMARY OF INVENTION

Problem to be Solved by the Invention

However, the inkjet recording device according to Patent Literature 1 has a problem that because each ejection pulse is synchronized with the natural oscillation period of the pressure chamber, when ejection pulses are simply applied one after another, and two ink droplets are ejected in one pixel period, the ejection speed of the ink droplet ejected on the basis of the later ejection pulse in the pixel period becomes greater by being influenced by the earlier ejection pulse therein.

The inkjet recording device according to Patent Literature 1 has another problem that, as shown by the dashed line in FIG. 12*ii*, reverberating vibration caused by an ejection pulse in a certain pixel period exerts influence on the ejection speed of an ink droplet in the next pixel period. Although the influence of reverberating vibration can be suppressed by application of a cancel pulse, as shown in FIG. 12*i*, a conventional cancel pulse has a voltage the polarity of which is reverse to that of the voltage of an ejection pulse with respect to the standby voltage V0, and such a conventional cancel pulse is applied. Accordingly, the voltage width of voltages used in the entire drive waveform signal is wide.

In consideration of the above, it is an object of the present invention to provide an inkjet recording device and a method for generating a drive waveform signal by which, in a case where zero to two ink droplets are ejected in one pixel period, ink droplets within one pixel period and ink droplets in different pixel periods can be ejected at approximately the same ejection speed, and the voltage width of voltages used can be widen as less as possible.

Means for Solving Problems

In order to solve the above described problems, the invention described in claim 1 is an inkjet recording device, including: a recording head which includes a nozzle, a pressure chamber communicating with the nozzle, and a pressure generation unit for applying pressure to ink in the pressure chamber, and ejects an ink droplet from the nozzle by the pressure applied to the ink by the pressure generation unit in response to a drive waveform signal applied to the pressure generation unit; and a drive waveform signal generation unit which generates the drive waveform signal for causing the recording head to eject zero to two ink droplets to one pixel, the drive waveform signal including an ejection pulse for ejecting one ink droplet and a cancel pulse for suppressing influence of reverberating vibration caused by the ejection pulse, wherein when causing the recording head to eject one ink droplet to one pixel, the drive waveform signal generation unit generates a first drive waveform signal which includes, in one pixel period, a first ejection pulse having a pulse width equal to AL which is a half period of a natural oscillation period of the pressure chamber, and a first cancel pulse being applied after 2 AL from finishing time of the first ejection pulse and having the same polarity as the first ejection pulse, and when causing the recording head to eject two ink droplets to one pixel, the drive waveform signal generation unit generates a second drive waveform signal which includes, in one pixel period, a second ejection pulse having a pulse width equal to AL, a third ejection pulse being applied after AL from finishing time of the second ejection pulse and having a pulse width equal to AL, and a second cancel pulse being applied from finishing time of the third ejection pulse and having the same polarity as the third ejection pulse, and a voltage V1 of each of the ejection pulses and a voltage V2 of the second cancel pulse satisfy a relationship V1>V2, and the voltage V1 of each of the ejection pulses and a voltage V3 of the first cancel pulse satisfy a relationship V1>V3.

Moreover, the invention described in claim 2 is the inkjet recording device according to claim 1, wherein a pulse width of the first cancel pulse is equal to AL, and the voltage V1 of each of the ejection pulses, the voltage V2 of the second cancel pulse and the voltage V3 of the first cancel pulse satisfy a relationship V1>V2>V3.

Moreover, the invention described in claim 3 is the inkjet recording device according to claim 2, wherein when viscosity of the ink is represented by X, V2/V1 is represented by Y, and V3/V1 is represented by Z, a relationship between X and Y falls within a region surrounded by a curve expressed by a following equation (1) and a curve expressed by a following equation (2), and a relationship between X and Z falls within a region surrounded by a curve expressed by a following equation (3) and a curve expressed by a following equation (4):

$$Y=0.0014X^2-0.055X+0.91 \quad (1);$$

$$Y=-0.0036X^2+0.06X+0.21 \quad (2);$$

$$Z=0.003X^2-0.073X+0.62 \quad (3); \text{ and}$$

$$Z=-0.005X^2+0.097X-0.03 \quad (4).$$

Moreover, the invention described in claim 4 is the inkjet recording device according to claim 1, wherein a pulse width of the first cancel pulse is not equal to AL, and the voltage V1 of each of the ejection pulses, the voltage V2 of the second cancel pulse and the voltage V3 of the first cancel pulse satisfy a relationship V1>V2=V3.

Moreover, the invention described in claim 5 is a method for generating a drive waveform signal used in an inkjet recording device including: a recording head which includes a nozzle, a pressure chamber communicating with the nozzle, and a pressure generation unit for applying pressure to ink in the pressure chamber, and ejects an ink droplet from the nozzle by the pressure applied to the ink by the pressure generation unit in response to a drive waveform signal applied to the pressure generation unit; and a drive waveform signal generation unit which generates the drive waveform signal for causing the recording head to eject zero to two ink droplets to one pixel, the drive waveform signal including an ejection pulse for ejecting one ink droplet and a cancel pulse for suppressing influence of reverberating vibration caused by the ejection pulse, the method including: when causing the recording head to eject one ink droplet to one pixel, generating, with the drive waveform signal generation unit, a first drive waveform signal which includes, in one pixel period, a first ejection pulse having a voltage V1 and a pulse width equal to AL which is a half period of a natural oscillation period of the pressure chamber, and a first cancel pulse being applied after 2 AL from finishing time of the first ejection pulse and having the same polarity as the first ejection pulse and a voltage V3 smaller than the voltage V1, and when causing the recording head to eject two ink droplets to one pixel, generating, with the drive waveform signal generation unit, a second drive waveform signal which includes, in one pixel period, a second ejection pulse having a pulse width equal to AL and the voltage V1, a third ejection pulse being applied after AL from finishing time of the second ejection pulse and having a pulse width equal to AL and the voltage V1, and a second cancel pulse being applied from finishing time of the third ejection pulse and having the same polarity as the third ejection pulse and a voltage V2 smaller than the voltage V1.

Moreover, the invention described in claim 6 is the method for generating the drive waveform signal according to claim 5, wherein a pulse width of the first cancel pulse is equal to AL, and the voltage V1 of each of the ejection pulses, the voltage V2 of the second cancel pulse and the voltage V3 of the first cancel pulse satisfy a relationship V1>V2>V3.

Moreover, the invention described in claim 7 is the method for generating the drive waveform signal according to claim 6, wherein when viscosity of the ink is represented by X, V2/V1 is represented by Y, and V3/V1 is represented by Z, a relationship between X and Y falls within a region surrounded by a curve expressed by a following equation (1) and a curve expressed by a following equation (2), and a relationship between X and Z falls within a region surrounded by a curve expressed by a following equation (3) and a curve expressed by a following equation (4):

$$Y=0.0014X^2-0.055X+0.91 \quad (1);$$

$$Y=-0.0036X^2+0.06X+0.21 \quad (2);$$

$$Z=0.003X^2-0.073X+0.62 \quad (3); \text{ and}$$

$$Z=-0.005X^2+0.097X-0.03 \quad (4).$$

Moreover, the invention described in claim 8 is the method for generating the drive waveform signal according to claim 5, wherein a pulse width of the first cancel pulse is not equal to AL, and the voltage V1 of each of the ejection pulses, the voltage V2 of the second cancel pulse and the voltage V3 of the first cancel pulse satisfy a relationship V1>V2=V3.

Advantageous Effects of Invention

According to the present invention, an inkjet recording device and a method for generating a drive waveform signal can be provided, by which, in a case where zero to two ink droplets are ejected in one pixel period, ink droplets within one pixel period and ink droplets in different pixel periods can be ejected at approximately the same ejection speed, and the voltage width of voltages used can be widen as less as possible.

BRIEF DESCRIPTION OF DRAWINGS

FIG. 7A is a view representing a relationship between voltage ratios of respective voltages and droplet speed variation in a case where viscosity of ink is 5 (cp) and the recording head according to the embodiment is driven on the basis of the first drive waveform signal or the second drive waveform signal.

FIG. 7B is a view representing a relationship between voltage ratios of respective voltages and droplet speed variation in a case where viscosity of ink is 10 (cp) and the recording head according to the embodiment is driven on the basis of the first drive waveform signal or the second drive waveform signal.

FIG. 7C is a view representing a relationship between voltage ratios of respective voltages and droplet speed variation in a case where viscosity of ink is 15 (cp) and the recording head according to the embodiment is driven on the basis of the first drive waveform signal or the second drive waveform signal.

EMBODIMENTS FOR CARRYING OUT THE INVENTION

Hereinafter, a description is made regarding Embodiment 1 of an inkjet recording device according to the present invention with reference to FIGS. 1 to 11.

Figure 1:
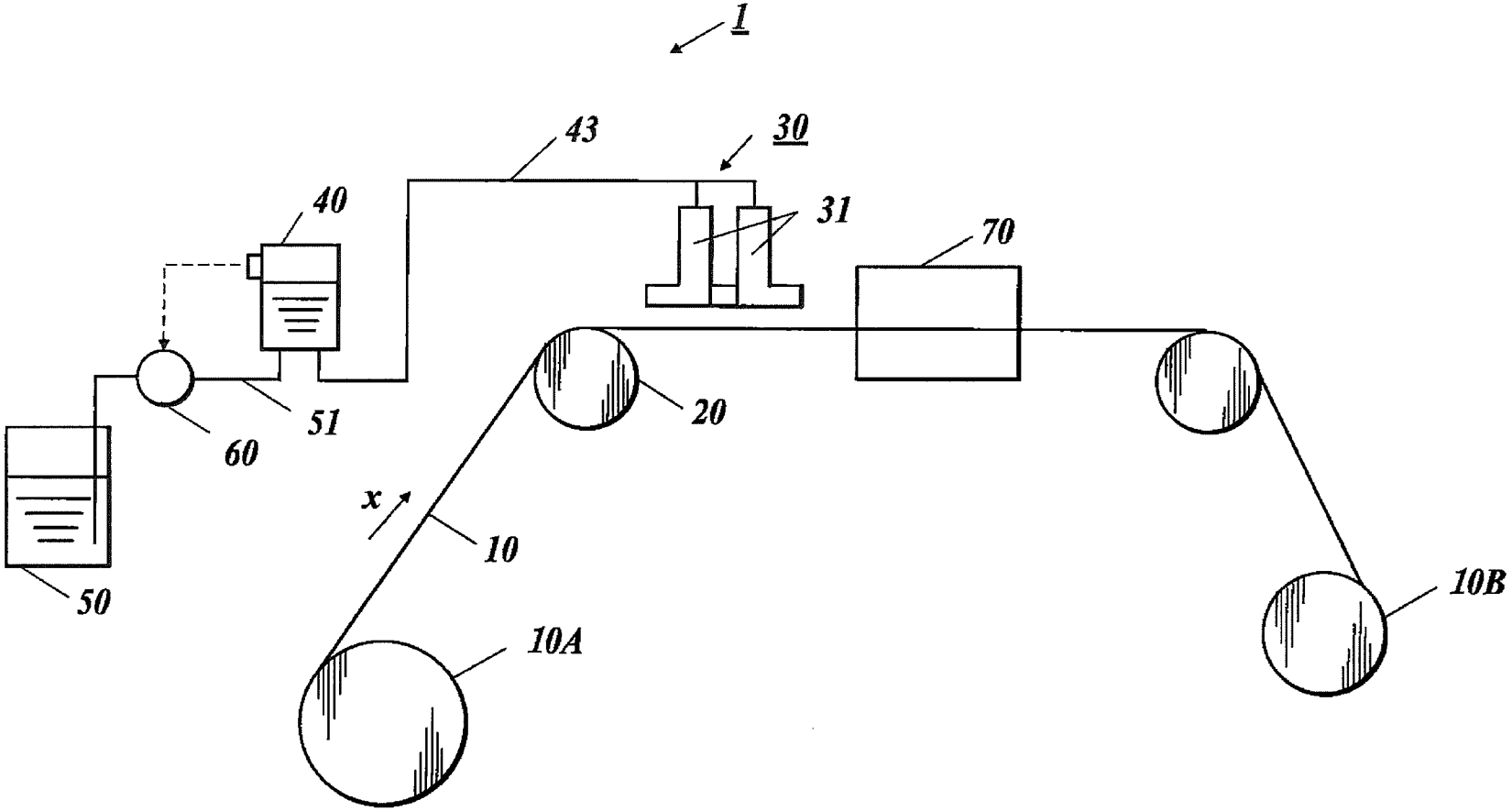
FIG. 1 is a schematic view showing a configuration of an inkjet recording device according to a present embodiment.

An inkjet recording device 1 is the line head inkjet recording device. As shown in FIG. 1, the inkjet recording device 1 is configured by including: an unwind roller 10A for unwinding a long recording medium 10 wound therearound; a wind-up roller 10B for winding up the recording medium 10 unwound from the unwind roller 10A; a back roller 20 provided between the unwind roller 10A and the wind-up roller 10B; an inkjet head part 30 for ejecting ink onto the recording medium 10; an intermediate tank 40 for supplying the ink to the inkjet head part 30; a storage tank 50 for storing the ink to be supplied to the intermediate tank 40 by an ink delivering pump 60; and a fixing mechanism 70 for fixing the ink, which is ejected onto the recoding medium 10, on the recording medium 10.

Each of the unwind roller 10A, the wind-up roller 10B and the back roller 20 is a member rotatable on its shaft part and formed in a cylindrical shape.

The unwind roller 10A winds up the recording medium 10 therearound many times. The unwind roller 10A is rotated by using a not-shown driving unit such as a motor to let out and convey the recording medium 10 in a direction X indicated in FIG. 1. The wind-up roller 10B winds up therearound the recording medium 10 unwound from the unwind roller 10A.

The back roller 20 supports the recording medium 10 conveyed from the unwind roller 10A by winding the same on a part of the periphery thereof and conveys the recording medium 10 to the wind-up roller 10B.

The inkjet head part 30 is provided in the vicinity of the back roller 20, ejects the ink to the recording medium 10 in a form of ink droplets and performs image formation on the basis of image data. The inkjet head part 30 has recording heads 31 for ejecting the ink droplets. Because the ejection width of one recording head 31 is narrower than an outer dimension of the recording head 31, in the inkjet head part 30, a plurality of recording heads 31 are arranged in a staggered manner with respect to the upper surface of the recording medium 10 so that the ink droplets can be ejected onto the recording medium 10 without any gaps.

Figure 2:
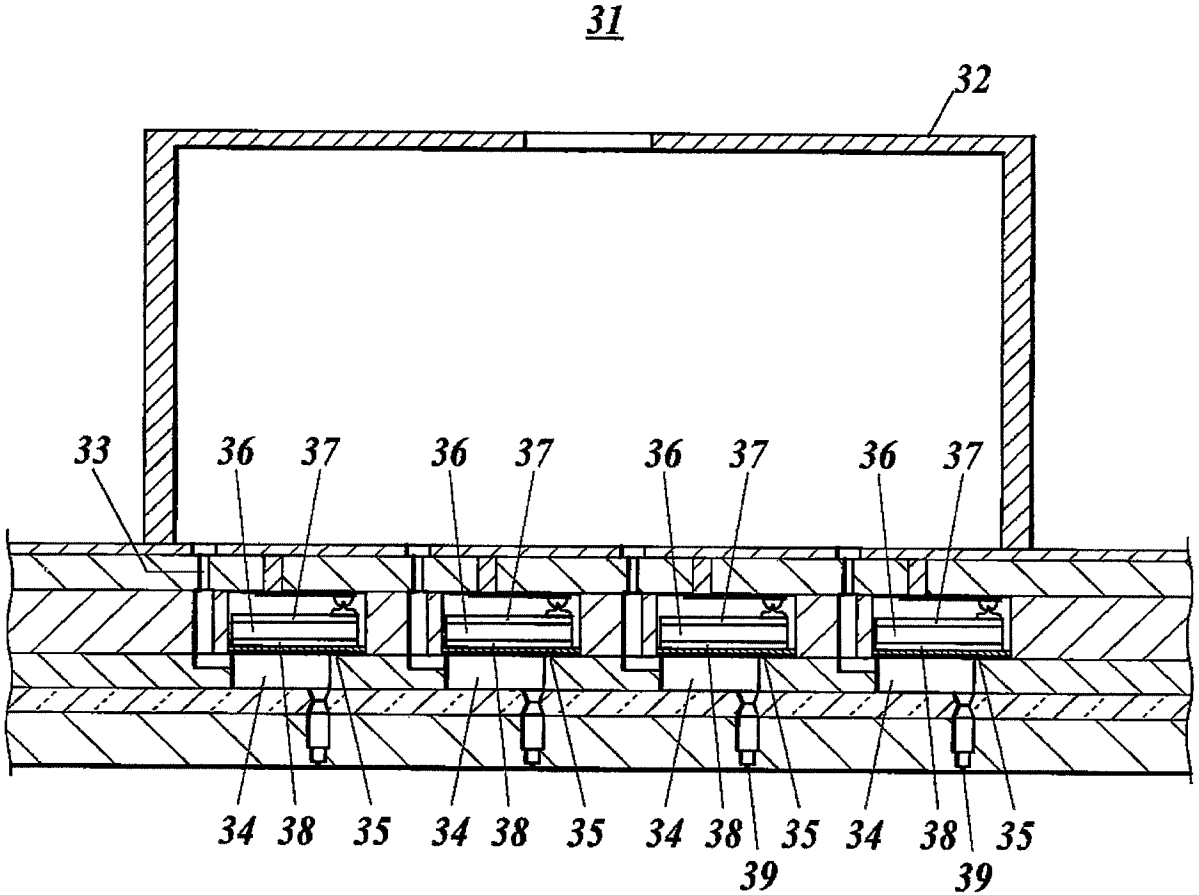
FIG. 2 is a cross-sectional view showing a head provided in the inkjet recording device of FIG. 1.

As shown in FIG. 2, a recording head 31 is configured by including: an ink chamber 32 for storing therein the ink supplied from the intermediate tank 40; hole portions 33 for conveying the ink inside the ink chamber 32 downward; pressure chambers 34 which communicate with the hole portions 33 and to which the ink is supplied through the hole portions 33; vibration plates 35 which cover the upper surfaces of the pressure chambers 34; piezoelectric elements 36 (pressure generation units) provided above the vibration plates 35; two types of electrodes, i.e., electrodes 37 and 38, respectively positioned on the upper surfaces and the lower surfaces of the piezoelectric elements 36; and a plurality of nozzles 39 which communicate with the pressure chambers 34 through the lower surfaces thereof and eject the ink inside the pressure chambers 34 in a form of ink droplets. The hole portion 33 to the electrode 38 are provided for each nozzle 39.

The ink chamber 32 stores the ink supplied from the intermediate tank 40 via later-described ink tubes 43. The hole portion 33 is a hole that connects the lower surface of the ink chamber 32 and the side surface of the pressure chamber 34 and conveys the ink inside the ink chamber 32 to the pressure chamber 34.

The pressure chamber 34 stores therein the ink supplied through the hole portion 33. The pressure chamber 34 has the upper surface being covered with the vibration plate 35 and the lower surface being connected to the nozzle 39. The pressure chamber 34 applies pressure to the ink stored therein in response to vibration of the vibration plate 35 and pushes the ink into the nozzle 39. The vibration plate 35 is arranged between the piezoelectric element 36 (electrode 38) and the pressure chamber 34 and joined to the upper surface of the pressure chamber 34. The vibration plate 35 vibrates in response to deformation of the piezoelectric element 36 to make pressure waves propagate into the pressure chamber 34.

The piezoelectric element 36 is made of lead zirconate titanate (PZT). The piezoelectric element 36 is an actuator sandwiched between the electrodes 37 and 38 in the up-down direction and causes the vibration plate 32 to vibrate by deforming depending on a potential difference between the electrodes 37 and 38. Here, of the electrodes 37 and 38 of each recording head 31, the electrodes 37 are independent electrodes provided for a later-described drive circuit 200 provided for each recording head 31 (i.e., for a unit of the piezoelectric elements 36 included in each recording head 31), and the electrode 38 is a common electrode shared in each recording head 31.

The nozzle 39 ejects the ink pushed from the pressure chamber 34 in a form of ink droplets.

The intermediate tank 40 temporarily stores the ink supplied from the storage tank 50. The intermediate tank 40 is connected with a plurality of ink tubes 43 and supplies the ink to each recording head 31 after adjusting back pressure of the ink in the recording head 31.

The storage tank 50 stores the ink to be supplied to the intermediate tank 40 through a supply pipe 51. The ink is pumped up by the ink delivering pump 60 arranged halfway through the supply pipe 51.

The fixing mechanism 70 fixes the ink ejected from the inkjet head part 30 onto the recording medium 10. The fixing mechanism 70 is configured by including a heater for fixing the ejected ink by heat onto the recording medium 10 and an UV lamp for curing the ink by irradiating the ink with UV (ultraviolet) light.

Next, a control configuration of the inkjet recording device 1 is described with reference to a block diagram of FIG. 3.

Figure 3:
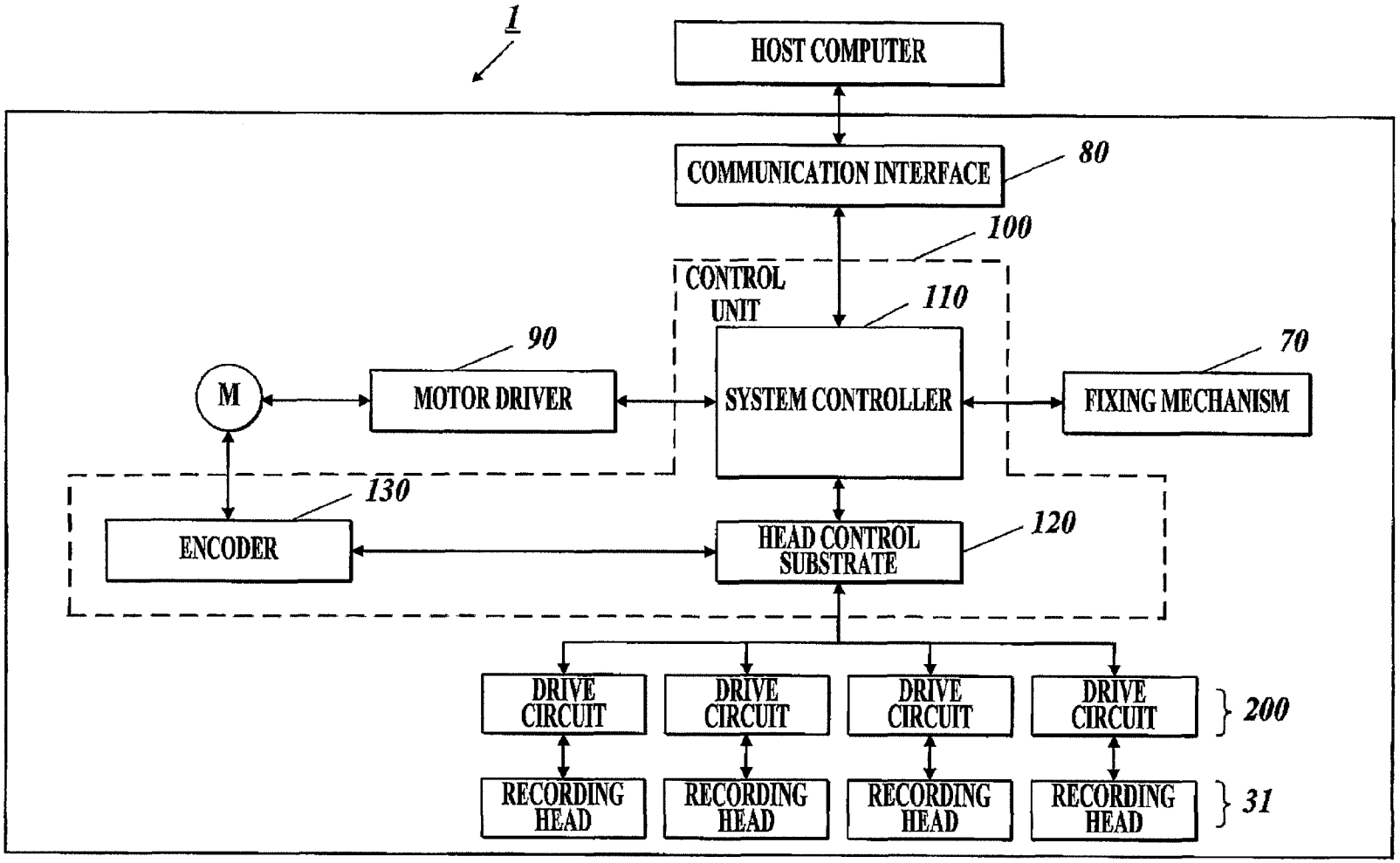
FIG. 3 is a block diagram showing a control configuration of the inkjet recording device of FIG. 1.

As shown in FIG. 3, the inkjet recording device 1 is configured by including a control unit 100, the fixing mechanism 70, a communication interface unit 80, a motor driver 90, a motor M, the drive circuits 200 and the recording heads 31 connected to the drive circuits 200. The fixing mechanism 70, the communication interface unit 80, the motor driver 90, the motor M and the drive circuits 200 are connected to the control unit 100. The fixing mechanism 70 and the recording heads 31 are as described above; therefore, the descriptions thereof are omitted.

The communication interface unit 80 is an interface for the control unit 100 to communicate with a host computer via a local area network (LAN) or the like.

For example, the communication interface unit 80 receives image data sent from the host computer and sends the image data to the control unit 100.

The motor driver 90 is a driver to perform drive control of the motor M, and the motor M is, for example, a motor for making the recording heads 31 move along a main scanning direction.

The control unit 100 is configured by including a system controller 110, a head control substrate 120 (drive waveform signal generation unit) and an encoder 130.

The system controller 110 is configured by including a CPU, a RAM, a ROM and an image memory and integrally controls operations of the inkjet recording device 1 by executing programs in the ROM. Specifically, the system controller 110 performs communication control of communication with the host computer, reading/writing control of the image memory, drive control of the motor M through the motor driver 90, fixing operation control of the fixing mechanism 70 and the like.

The head control substrate 120 is configured by including: a page memory for storing image data received from the host computer; a line memory for storing image data of respective pixels which are recorded on the recording medium 10 by being arranged in a line in a sub-scanning direction when recorded thereon; and a drive waveform signal generation circuit for generating drive waveform signals for driving the recording heads 31. The head control substrate 120 functions, in response to a command signal outputted from the system controller 110, as the drive waveform signal generation unit for generating the drive waveform signals for the recording heads 31 by using the drive waveform signal generation circuit.

The encoder 130 is a rotary encoder or the like for drive control of the motor M and outputs the number of pulses counted to the head control substrate 120.

The drive circuits 200 are circuits to drive their respective recording heads 31 on the basis of the drive waveform signals generated by the head control substrate 120.

Specifically, each drive circuit 200 is provided for the electrodes 37 as independent electrodes and the electrode 38 as the common electrode of the recording head 31. The electrodes 37 and the electrode 38 are arranged to sandwich the piezoelectric elements 36 in the up-down direction. The drive circuit 200 also includes: a plurality of voltage supply parts for generating later-described three voltages V1, V2 and V3 (potential differences between the electrodes 37 and 38) to be applied to the piezoelectric elements 36; and a plurality of field effect transistors (FETs) for switching the three voltages to use. Accordingly, when a drive waveform signal generated by the head control substrate 120 is inputted into the drive circuit 200, the drive circuit 200 appropriately switches the voltages V1, V2 and V3 to be applied to the piezoelectric elements 36 according to the inputted drive waveform signal so as to drive the recording head 31.

(Regarding Drive Waveform Signals)

Figure 4:
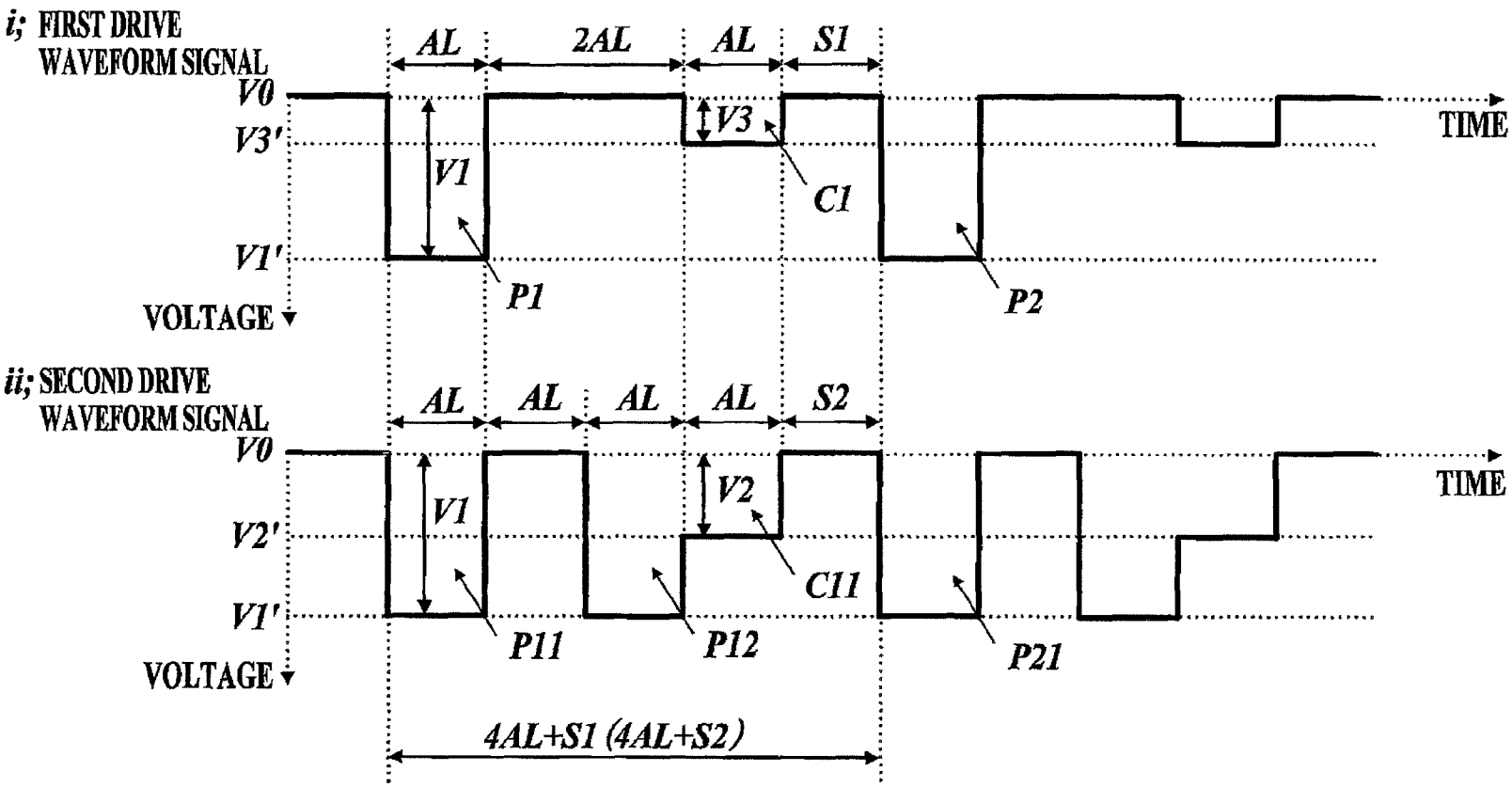
FIG. 4 is a view exemplifying a drive waveform signal according to the embodiment, wherein i; represents a first drive waveform signal, and ii; represents a second drive waveform signal.

Next, the drive waveform signals are described, which are generated by the head control substrate 120 to drive the recording heads 31. The head control substrate 120 generates the drive waveform signals (a first drive waveform signal and a second drive waveform signal) for driving each recording head 31 in the 2 drop per dot (dpd) drive system by which zero to two ink droplets are ejected from the recording head 31 in one pixel period. The first drive waveform signal is the one that the head control substrate 120 generates when causing each recording head 31 to eject one ink droplet in one pixel period, and the second drive waveform signal is the one that the head control substrate 120 generates when causing each recording head 31 to eject two ink droplets in one pixel period. FIG. 4 is a view for explaining the drive waveform signals generated by the head control substrate 120. FIG. 4*i*; represents the first drive waveform signal, and FIG. 4*ii*; represents the second drive waveform signal. The first drive waveform signal and the second drive waveform signal indicated in FIGS. 4*i*; and 4*ii*; are the drive waveform signals for causing each recording head 31 to eject ink droplets by a pull-push method by taking the voltage of the recording head 31 in standby as a standby voltage V0.

As described later, V1, V2 and V3 are voltages of an ejection pulse, a second cancel pulse and a first cancel pulse, respectively.

The voltage herein is an absolute value of the potential difference between the potential of each pulse and the potential of the standby voltage V0, and polarity of each pulse is polarity of the potential difference.

As shown in FIG. 4, when the potential of each ejection pulse is represented by V1', the potential of the first cancel pulse is represented by V3' and the potential of the second cancel pulse is represented by V2', the following equations can be made.

$$\text{Voltage } V1=|V1'-V0|$$

$$\text{Voltage } V2=|V2'-V0|$$

$$\text{Voltage } V3=|V3'-V0|$$

Figure 12:
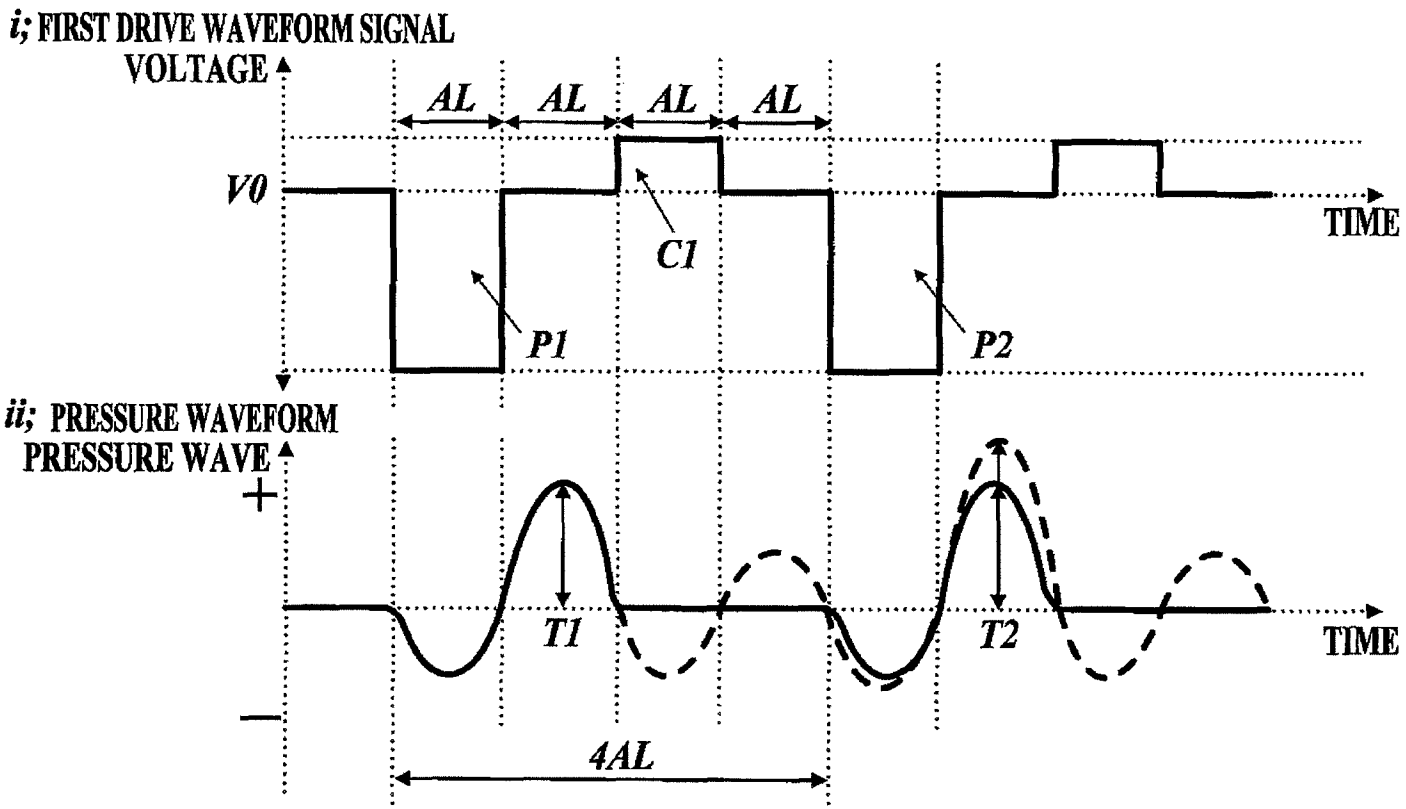
FIG. 12 is a view showing a conventional drive waveform signal and pressure waves of the pressure chamber in a case where the head is driven on the basis of the drive waveform signal, wherein i; represents the drive waveform signal, and ii; represents the waveform of the pressure waves.
Figure 13:
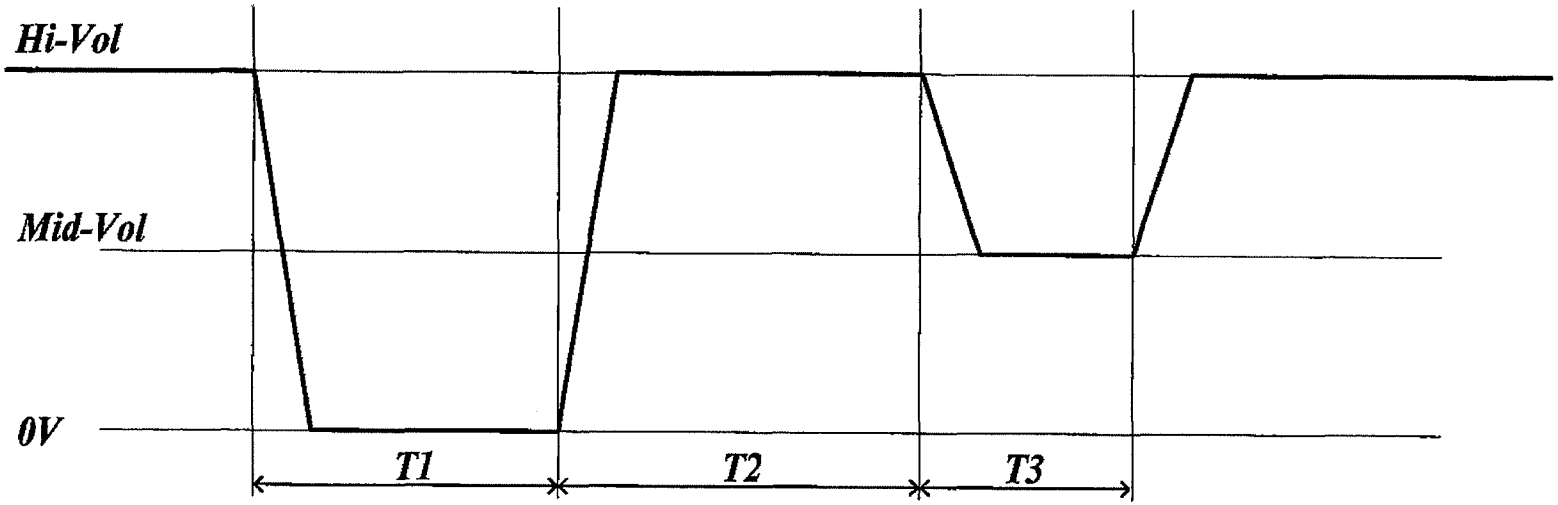
FIG. 13 is a view exemplifying pulse widths.

The ejection pulse, the first cancel pulse and the second cancel pulse having the same polarity means V1'−V0, V2'−V0 and V3'−V0 having the same polarity (either positive or negative). In FIG. 4, each of the ejection pulses, the first cancel pulse and the second cancel pulse all have negative polarity, whereas in the conventional example shown in FIG. 12, the ejection pulse P1 has negative polarity, but the cancel pulse C1 has positive polarity.

The present invention is not limited to the pull-push method and can employ a push method. When the push method is employed in the case of FIG. 4, each of the ejection pulses, the first cancel pulse and the second cancel pulse all have positive polarity.

As shown in FIG. 4*i*, the first drive waveform signal includes, in one pixel period, an ejection pulse P1 (a first ejection pulse) which has a voltage V1 (|V1'−V0|) and a cancel pulse C1 (a first cancel pulse) which has a voltage V3 (|V3'−V0|). Here, one pixel period is an interval from the starting time of the ejection pulse P1 to the starting time of an ejection pulse P2 (a first ejection pulse) and has a time length of 4 AL+S1 (AL: a half period of a natural oscillation period of the pressure chamber 34). The voltages V1 and V3 satisfy a relationship V1>V3.

The ejection pulse P1 is a drive pulse for the recording head 31 and is set such that the pulse width is equal to AL based on the natural oscillation period of the pressure chamber 34 in order to cause the recording head 31 to eject an ink droplet with a stable ejection characteristic. As shown in FIGS. 4*i*; and 5, when the ejection pulse P1 is applied to the recording head 31 (piezoelectric element 36), the potential decreases from V0 to V0−V1, and during the process of the potential decrease, a negative pressure wave acts in the pressure chamber 34 by the piezoelectric element 36, and the ink is drawn into the pressure chamber 34. Thereafter, when the potential increases from V0−V1 to V0, a positive pressure wave acts in the pressure chamber 34, and the ink is pushed from the pressure chamber 34. As a result, the ink in the pressure chamber 34 is ejected as one ink droplet at time T1 indicated in FIG. 5 from the nozzle 39 connected to the lower surface of the pressure chamber 34.

The cancel pulse C1 is a pulse applied to the recording head 31 for suppressing influence of reverberating vibration of the pressure wave generated in the pressure chamber 34 by the ejection pulse P1, and the pulse width is set to AL. The cancel pulse C1 is, as shown in FIG. 4*i*, applied after 2 AL from the finishing time of the ejection pulse P1.

When the recording head 31 is driven on the basis of the first drive waveform signal, and the ejection pulse P1 thereof is applied to the recording head 31, as described above, in the pressure chamber 34, the positive pressure wave acts after the negative pressure wave acts, so that an ink droplet is ejected at time T1. If the cancel pulse C1 is not applied, as indicated by a dashed line in FIG. 5, by the influence of reverberating vibration caused by the application of the ejection pulse P1, the ejection speed of the ink droplet ejected by the ejection pulse P2 at time T2 in the next pixel period becomes less than that of the ink droplet ejected at time T1.

However, if the cancel pulse C1 is applied after AL from the finishing time of the ejection pulse P1 as shown in FIG. 12*i*; in order to suppress the influence of reverberating vibration thereof, the polarity of the voltage V3 of the cancel pulse C1 needs to be reverse to that of the voltage V1 of the ejection pulse P1 because the negative pressure wave acts in the pressure chamber 34 at the time. In this case, the voltage width in the entire first drive waveform signal is wide.

Hence, as described above, the cancel pulse C1 is applied after 2 AL from the finishing time of the ejection pulse P1, and accordingly the cancel pulse C1 is applied at the time when the positive pressure wave acts in the pressure chamber 34. This can make the polarity of the voltage V3 the same as that of the voltage V1 of the ejection pulse P1. This narrows the voltage width in the entire first drive waveform signal.

Figure 5:
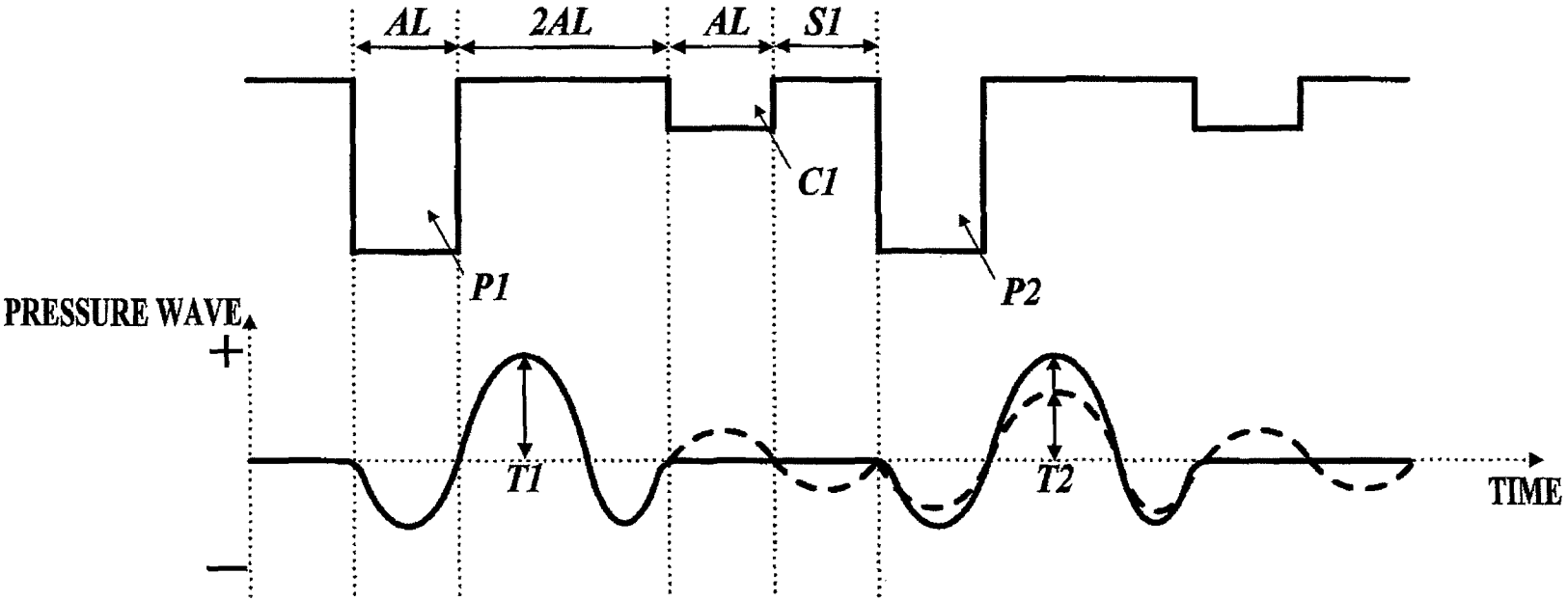
FIG. 5 is a view exemplifying a waveform of pressure waves in a pressure chamber in a case where the head is driven on the basis of the first drive waveform signal according to the embodiment.

In addition, as indicated by a solid line in FIG. 5, when the cancel pulse C1 is applied to the recording head 31, the ejection speeds (pressure) of ink droplets in different pixel periods become approximately the same, which are indicated at times T1 and T2, because the influence of reverberating vibration is suppressed thereby.

As shown in FIG. 4*ii*, the second drive waveform signal includes, in one pixel period, ejection pulses P11 and P12 (a second ejection pulse and a third ejection pulse, respectively) each having the voltage V1 which is the same as that of the ejection pulse P1 and a cancel pulse C11 (a second cancel pulse) having a voltage V2 (|V2'−V0|). Here, one pixel period is an interval from the starting time of the ejection pulse P11 to the starting time of an ejection pulse P21 (a second ejection pulse) and has a time length of 4 AL+S2 (=S1) as with the first drive waveform signal. The voltages V2 and V3 satisfy a relationship V2>V3.

Each of the ejection pulses P11 and P12 is a drive pulse for causing the recording head 31 to eject one ink droplet, and the pulse width is set to AL. According to the second drive waveform signal, within one pixel period, the ejection pulse P11 is applied and the ejection pulse P12 is applied after AL from the finishing time of the ejection pulse P11. Here, the initial ejection speeds of ink droplets ejected by the ejection pulse P11 and the ejection pulse P12 are equal; however, a degree of its deceleration by air resistance is larger for the ink droplet ejected by the ejection pulse P11. This means that while the ink droplet ejected by the ejection pulse P11 decelerates by air resistance, the ink droplet ejected by the ejection pulse P12 has less air resistance due to the preceding ink droplet ejected by the ejection pulse P11 and hence decelerates with a smaller degree. Accordingly, the ink droplets ejected from the recording head 31 by the ejection pulse P11 and the ejection pulse P12 combine by the ink droplet ejected by the ejection pulse P12 catching up with the ink droplet ejected by the ejection pulse P11 after these ink droplets being ejected from the recording head 31, and land on a sheet of recording paper as one ink droplet for a single pixel.

The cancel pulse C11 is a pulse applied to the recording head 31 for suppressing influence of reverberating vibration of the pressure wave generated in the pressure chamber 34, and the pulse width is set to AL. The voltage V2 of the cancel pulse C11 has the same polarity as that of the voltage V1 and has a larger potential difference with respect to the standby voltage V0 than the voltage V3 of the cancel pulse C11. As shown in FIG. 4*ii*, the cancel pulse C11 is applied from the finishing time of the ejection pulse P12. Accordingly, the cancel pulse C11 is applied at the same timing as the cancel pulse C1.

Figure 6:
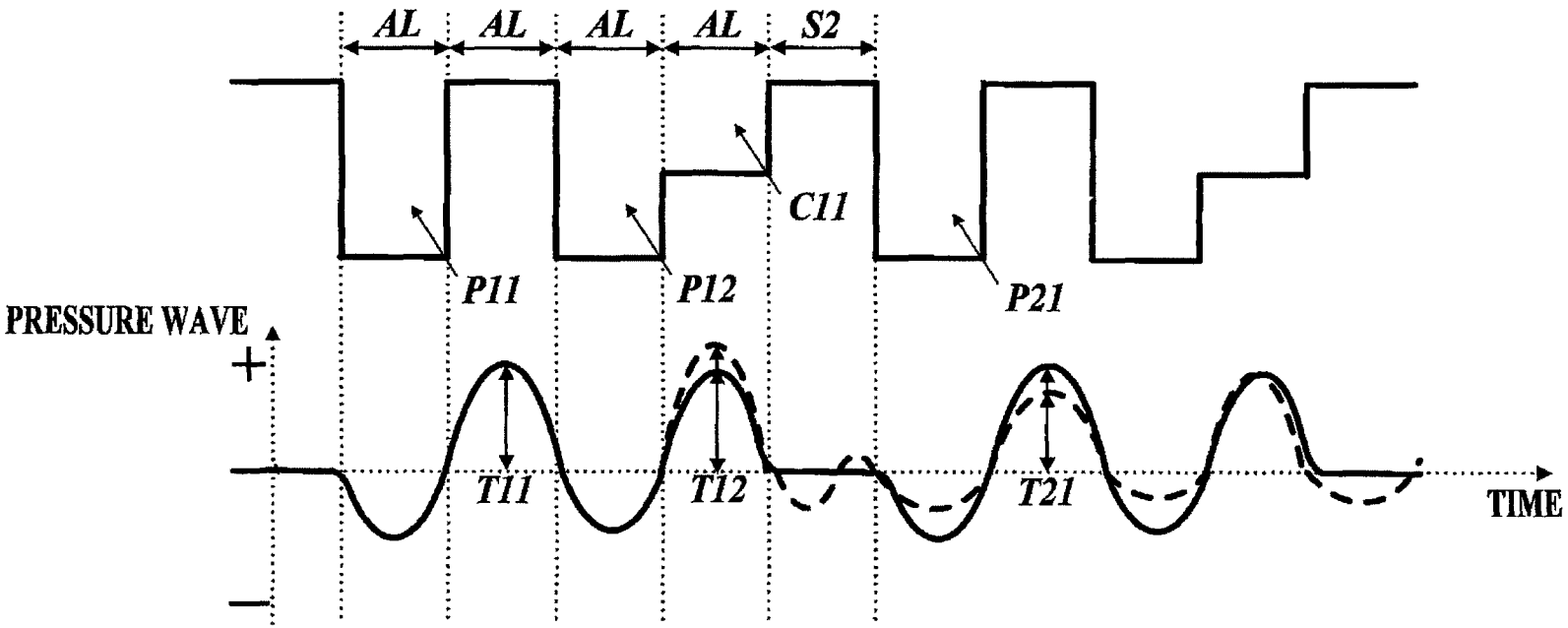
FIG. 6 is a view exemplifying a waveform of pressure waves in the pressure chamber in a case where the head is driven on the basis of the second drive waveform signal according to the embodiment.

Incidentally, if the cancel pulse is not applied, and instead, the ejection pulse P12 is being applied to the recording head 31 at time T12, as indicated by a dashed line in FIG. 6, by the influence of reverberating vibration caused by the application of the ejection pulse P12, the ejection speed of the ink droplet ejected by the ejection pulse P21 at time T21 in the next pixel period becomes less than that of the ink droplet ejected by the ejection pulse P12 at time T12. In particular, the influence of reverberating vibration on the ink droplet ejected by the ejection pulse P21 becomes larger because the time interval from time T12 to time T21 is shorter than that from time T1 to time T2 in the case of the recording head 31 being driven according to the first drive wave signal shown in FIG. 5. However, as described above, according to the second drive waveform signal, the cancel pulse C11 for suppressing the influence of reverberating vibration is applied, which is the same as the cancel pulse C1, and the voltage V2 of the cancel pulse C11 is set larger than the voltage V3 of the cancel pulse C1; therefore, the influence of reverberating vibration is sufficiently suppressed. It is preferable to set the relationship between the voltages V2 and V3 to V2>V3 as described above to enhance the effect of suppressing the influence of reverberating vibration.

When the cancel pulse C11 is not applied, as indicated by a dashed line in FIG. 6, the ejection speed of the ink droplet ejected by the ejection pulse P12 becomes greater than that of the ink droplet ejected by the ejection pulse P11 due to the influence of the reverberating vibration caused by the application of the ejection pulse P11. However, as described above, the cancel pulse C11 is applied from the finishing time of the ejection pulse P1, and accordingly, as shown in FIGS. 4*ii*; and 6, a potential change (V1−V2) from the time at which the ejection pulse P12 is applied to time T12 becomes smaller than a potential change (V1) from the time at which the ejection pulse P11 is applied to time T11. By this, the positive pressure wave acting at time T12 becomes smaller, and accordingly, the pressure for pushing the ink from the pressure chamber 34 is reduced. As a result, the influence of reverberating vibration caused by the application of the ejection pulse P11 at time T12 is suppressed, which makes the ejection speed of the ink droplet ejected by the ejection pulse P12 approximately equal to that of the ink droplet ejected by the ejection pulse P11.

FIGS. 7A, 7B and 7C show simulation results regarding a relationship between voltage ratios of respective voltages (V1, V2 and V3) and droplet speed variation under the condition that the natural frequency of the pressure chamber 34 was 150 (kHz), the recording head 31 was driven on the basis of the first or second drive waveform signal, and the ink viscosity was set to 5 (cp), 10 (cp) and 15 (cp), respectively. Here, V1*, V2* and V3* in FIG. 7 each represent a voltage ratio obtained by the voltage being divided by V1, and Judgment therein represents a judgment as to whether or not increase/decrease between the ejection speeds of ink droplets fell within a predetermined range when the voltage ratios in each row was used. When the increase/decrease fell within a range of ±1 (m/s), the judgment was made as "G" (Good); when the increase/decrease was out of the range of ±1 (m/s) but within a range of ±1.5 (m/s), the judgment was made as "F" (Fair); and when the increase/decrease was out of the range of ±1.5 (m/s), the judgment was made as "NG" (Not Good).

The cancel pulses C1 and C11 were not applied in the comparative examples in FIGS. 7A to 7C, whereas in the examples of the present invention, the cancel pulses C1 and C11 were applied with numerical ranges indicated in FIGS. 7A to 7C, the numerical ranges corresponding to ranges of 0<V3*<1 and 0<V2*<1, respectively. The rows with the judgment of "G" satisfy a relationship V2*>V3*(V2>V3). The "any" in V2* is an arbitrary value that falls within the range of 0<V2*<1, and the "any" in V3* is an arbitrary value that falls within the range of 0<V3*<1.

As understood from FIGS. 7A to 7C, by the cancel pulses C1 and C11 being applied with the ranges of 0<V3*<1 and 0<V2*<1, respectively, the ejection speed of an ink droplet ejected on the basis of each ejection pulse can be kept within the range of ±1.5 (m/s).

Specifically, the ejection speed of an ink droplet ejected on the basis of each ejection pulse can be kept within the range of ±1 (m/s) by the relationship V2*>V3*(V2>V3) being true and the voltage ratio to use being; for a viscosity of 5 (cp), V1*:V2*:V3*=1:0.42 to 0.67:0.33; for a viscosity of 10 (cp), V1*:V2*:V3*=1:0.45 to 0.5:0.19 to 0.44; and for a viscosity of 15 (cp), V1*:V2*:V3*=1:0.3 to 0.4:0.2 to 0.3.

Further, among combinations of v2* and v3* with the judgment of "F" in FIGS. 7A to 7C, combinations which satisfy the relationship V2*>V3*(V2>V3) tended to make the difference in the ejection speeds of ink droplets ejected on the basis of on their respective ejection pulses smaller.

Figure 8A:
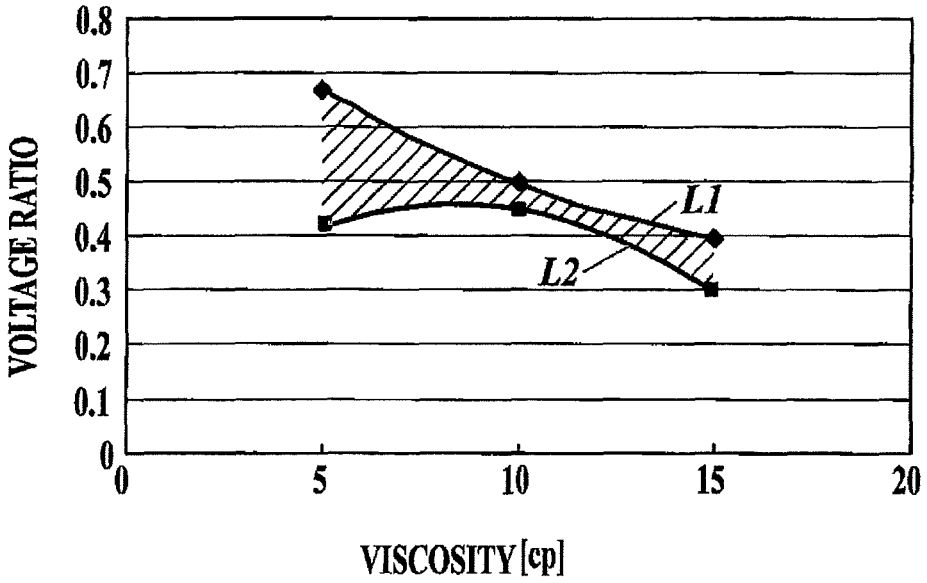
FIG. 8A is a view exemplifying approximate curves each representing a correspondence relationship between viscosity of ink and a voltage ratio (voltage V2/voltage V1) and a region surrounded by the approximate curves.
Figure 8B:
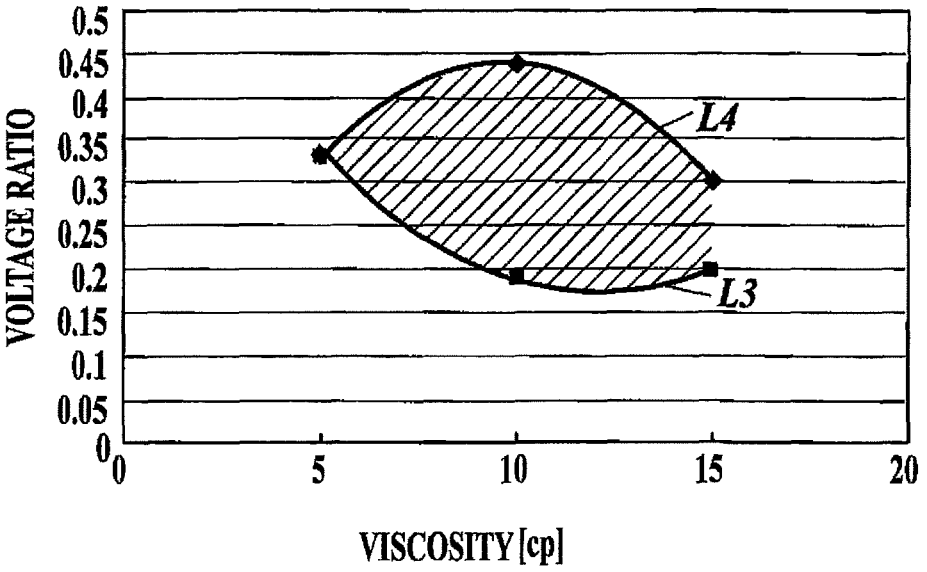
FIG. 8B is a view exemplifying approximate curves each representing a correspondence relationship between viscosity of ink and a voltage ratio (voltage V3/voltage V1) and a region surrounded by the approximate curves.

Further, regarding the rows with the judgment of "G" in FIGS. 7A to 7C, V2* for each viscosity is plotted within a region surrounded by approximate curves L1 and L2 as indicated in FIG. 8A, and V3* for each viscosity is plotted within a region surrounded by approximate curves L3 and L4 as indicated in FIG. 8B. The ejection speed of an ink droplet ejected on the basis of each ejection pulse can be kept within the range of ±1.0 (m/s) when V2* and V3* are respectively set such that a relationship between X and Y falls within a region surrounded by the curve L1 expressed by the following equation (1) and the curve L2 expressed by the following equation (2) as shown in FIG. 8A, and such that a relationship between X and Z falls within a region surrounded by the curve L3 expressed by the following equation (3) and the curve L4 expressed by the following equation (4) as shown in FIG. 8B, wherein X represents the ink viscosity, Y represents V2*=V2/V1, and Z represents V3*=V3/V1.

$$Y=0.0014X^2-0.055X+0.91 \quad (1)$$

$$Y=-0.0036X^2+0.06X+0.21 \quad (2)$$

$$Z=0.003X^2-0.073X+0.62 \quad (3)$$

$$Z=-0.005X^2+0.097X-0.03 \quad (4)$$

Here, the ink viscosity is the one at the time of ejection of the ink. No matter what the temperature, the viscosity can be known as long as a profile of viscosities and temperatures is known. For example, in the examples, a temperature of 30° C. was observed as a temperature of the head at the time of the head being driven, and the viscosity was specified from a known profile thereof.

(Regarding Operations of the Recording Heads in the 2 Dpd Drive System)

Next, operations of the head control substrate 120 to drive each recording head 31 in the 2 dpd drive system are described. First, when causing the recording head 31 to eject one ink droplet in each pixel period, the head control substrate 120 generates the first drive waveform signal shown in FIG. 4*i*. Then, the head control substrate 120 inputs, to the drive circuit 200, input signals (signals to switch on/off of the FETs) for causing the standby voltage V0, the voltage V1 of the ejection pulse P1 and the voltage V3 of the cancel pulse C1 to be applied to each piezoelectric element 36 at their respective timings according to the first drive waveform signal. Consequently, the drive circuit 200 appropriately switches the voltage to be applied to the piezoelectric element 36 from V0, V1, V0, V3 to V0, thereby causing the recording head 31 to eject one ink droplet in one pixel period. In this case, after the recording head 31 ejects an ink droplet to a pixel on the basis of the ejection pulse P1, the cancel pulse C1 is applied, and then the recording head 31 ejects an ink droplet to the next pixel on the basis of the ejection pulse P2. Accordingly, the ejection speeds thereof can be kept approximately equal.

On the other hand, when causing the recording head 31 to eject two ink droplets in each pixel period, the head control substrate 120 generates the second drive waveform signal shown in FIG. 4*ii*. Then, the head control substrate 120 inputs, to the drive circuit 200, input signals (signals to switch on/off of the FETs) for causing the standby voltage V0, the voltage V1 of the ejection pulses P11 and P12 and the voltage V2 of the cancel pulse C11 to be applied to each piezoelectric element 36 at their respective timings according to the second drive waveform signal. Consequently, the drive circuit 200 appropriately switches the voltage to be applied to the piezoelectric element 36 from V0, V1, V0, V1, V2 to V0, thereby causing the recording head 31 to eject the ink droplets. In this case, after the recording head 31 ejects an ink droplet to a pixel on the basis of the ejection pulse P11, the recording head ejects another ink droplet to the same pixel on the basis of the ejection pulse P12, whereby the two droplets combine and land on a sheet of recording paper as one ink droplet. The ejection speed of the ink droplet ejected on the basis of the ejection pulse P11 and the ejection speed of the ink droplet ejected on the basis of the ejection pulse P12, which are ejected in the same pixel period, and the ejection speed of the ink droplet ejected on the basis of the ejection pulse P21 in the next pixel period become approximately equal by the application of the cancel pulse C11. Further, because the voltage of the ejection pulse P1 and each of the voltages of the ejection pulses P11 and P12 are equal which are V1, the ejection speeds of the ink droplets ejected on the basis of the ejection pulses P1, P11 and P12 are also approximately equal.

A drive frequency of 50 kHz can be achieved with a print speed of 1 m/s and a print resolution of 1200 dpi when the natural frequency of the pressure chamber 34 is 125 (kHz), which is uniquely calculated by a known equation on the basis of flow passage shapes and a type ink in the recording head 31, and S1 (=S2) indicated in FIG. 4 is set to AL (pixel period: 5 AL). It is preferable that S1 (=S2) is set to AL or a multiple of AL (such as 2 AL or 3 AL).

(Experimental Results)

Figure 9A:
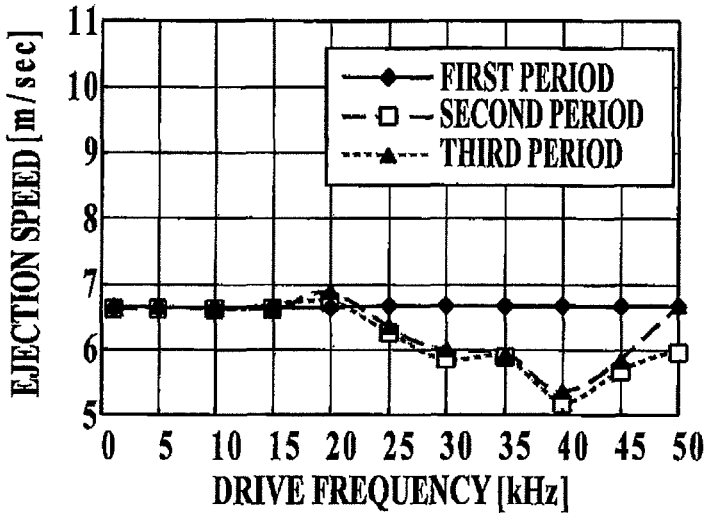
FIG. 9A is a view showing a result of an experiment of ejection speeds of ink droplets at respective drive frequencies from 0 to 50 (kHz) regarding a first drive waveform signal for three pixel periods, the first drive waveform signal which did not apply cancel pulses.
Figure 9B:
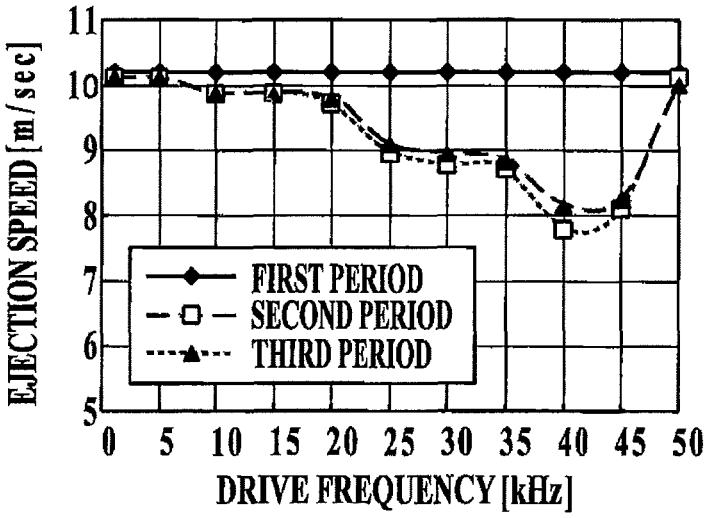
FIG. 9B is a view showing a result of the experiment of ejection speeds of ink droplets at respective drive frequencies from 0 to 50 (kHz) regarding a second drive waveform signal for three pixel periods, the second drive waveform signal which did not apply cancel pulses.
Figure 9C:
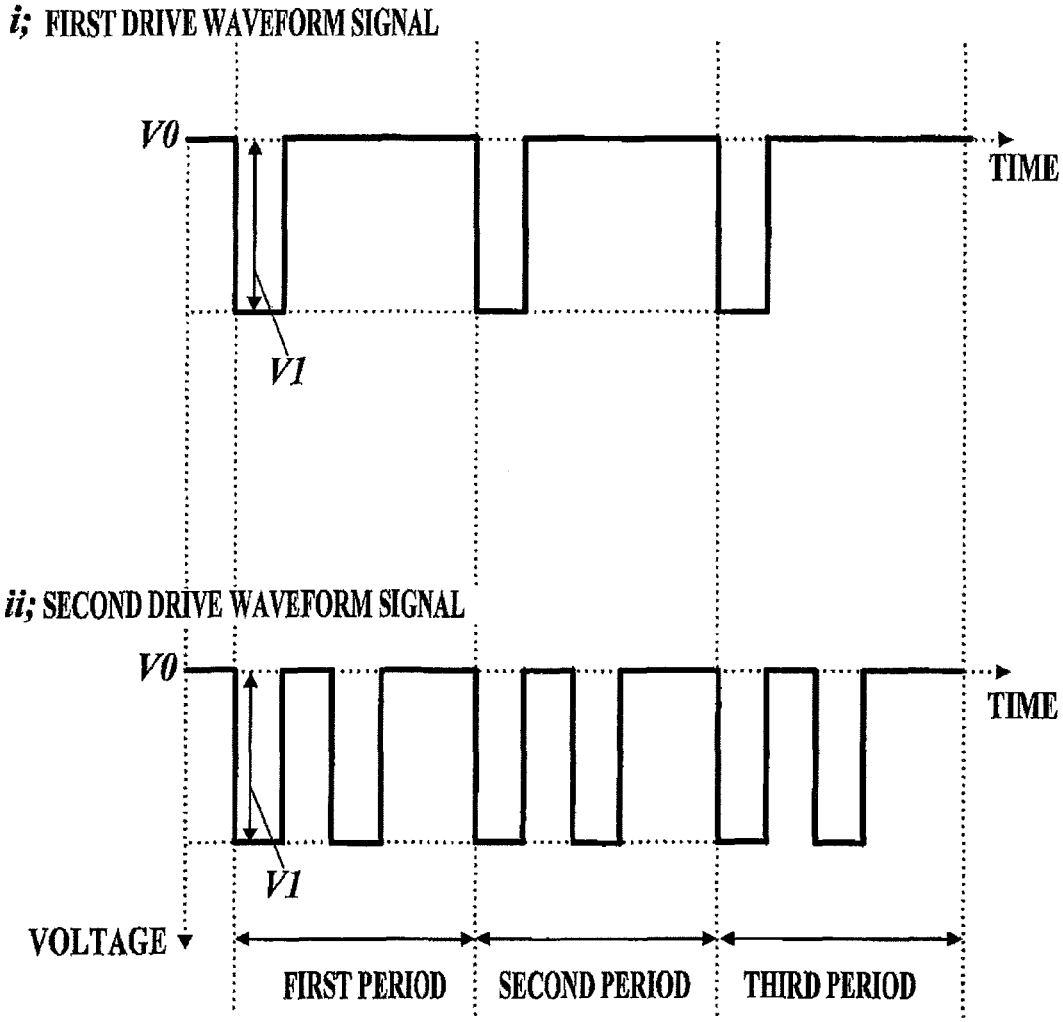
FIG. 9C is a view representing the first and second drive waveform signals for three pixel periods, the first and second drive waveform signals each of which did not apply cancel pulses, wherein i; represents the first drive waveform signal, and ii; represents the second drive waveform signal.
Figure 10A:
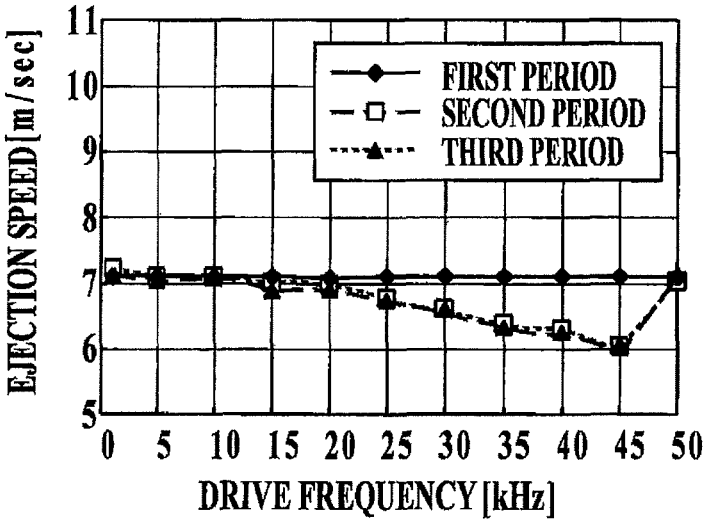
FIG. 10A is a view showing a result of the experiment of ejection speeds of ink droplets at respective drive frequencies from 0 to 50 (kHz) regarding a first drive waveform signal for three pixel periods, the first drive waveform signal which applied cancel pulses.
Figure 10B:
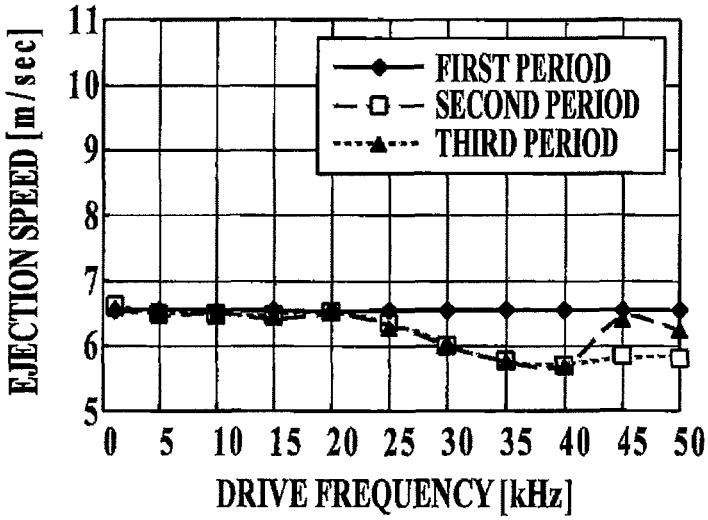
FIG. 10B is a view showing a result of the experiment of ejection speeds of ink droplets at respective drive frequencies from 0 to 50 (kHz) regarding a second drive waveform signal for three pixel periods, the second drive waveform signal which applied cancel pulses.
Figure 10C:
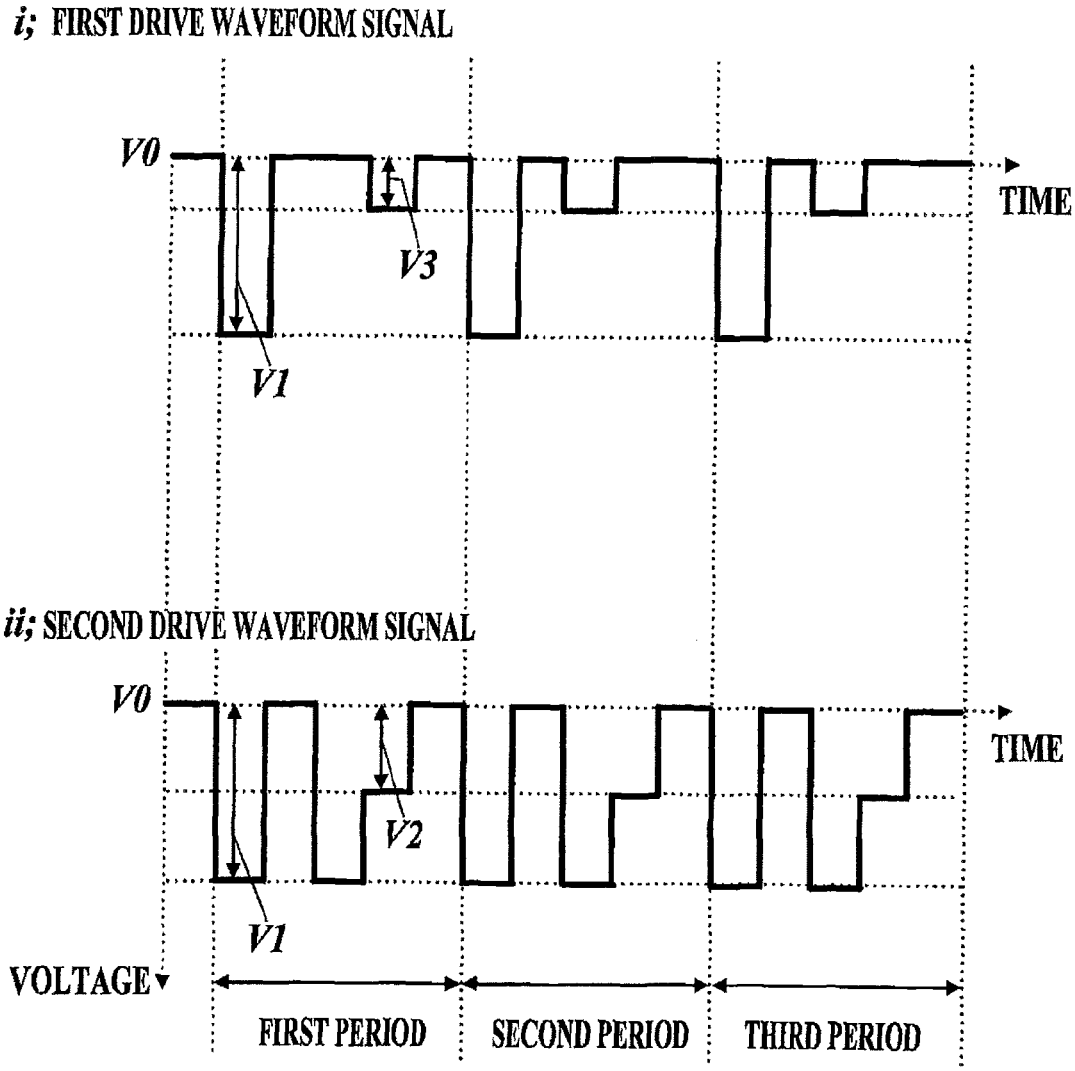
FIG. 10C is a view representing the first and second drive waveform signals for three pixel periods, the first and second drive waveform signals each of which applied cancel pulses, wherein i; represents the first drive waveform signal, and ii; represents the second drive waveform signal.

Next, experimental results of driving the recording head 31 by using the 2 dpd drive system are described. The experiment was made under the condition that the ink viscosity was 10 (cp), the natural frequency of the pressure chamber 34 was 150 (kHz), and AL was 3.3 (us). In this experiment, as shown in FIGS. 9A, 9B, 10A and 10B, the ejection speeds of ink droplets for three pixel periods of drive waveform signals were examined at drive frequencies from 0 to 50 (kHz). FIG. 9A shows the experimental result regarding a first drive waveform signal which did not apply cancel pulses. FIG. 9B shows the experimental result regarding a second drive waveform signal which did not apply cancel pulses. FIG. 10A shows the experimental result regarding a first drive waveform signal which applied cancel pulses. FIG. 10B shows the experimental result regarding a second drive waveform signal which applied cancel pulses. FIG. 9C shows the first and second drive waveform signals for three pixel periods, the drive waveform signals each of which did not apply cancel pulses, wherein i; shows the first drive waveform signal, and ii; shows the second drive waveform signal. FIG. 10C shows the first and second drive waveform signals for three pixel periods, the drive waveform signals each of which applied cancel pulses, wherein i; shows the first drive waveform signal, and ii; shows the second drive waveform signal.

According to the experimental results, in each of the first to third pixel periods, the second drive waveform signal which did not apply cancel pulses shown in FIG. 9B made the ejection speeds of ink droplets faster than those based on the first drive waveform signal which did not apply cancel pulses shown in FIG. 9A. On the other hand, in each of the first to third pixel periods, the second drive waveform signal which applied cancel pulses shown in FIG. 10B made the ejection speeds of ink droplets approximately equal to those based on the first drive waveform signal which applied cancel pulses shown in FIG. 10A. Further, the second drive waveform signal which applied cancel pulses shown in FIG. 10B made dispersion of the ejection speeds of ink droplets among the drive frequencies smaller than that based on the second drive waveform signal which did not apply cancel pulses shown in FIG. 9B. Similarly, the first drive waveform signal which applied cancel pulses shown in FIG. 10A made dispersion of the ejection speeds of ink droplets among the drive frequencies smaller than that based on the first drive waveform signal which did not apply cancel pulses shown in FIG. 9A. Thus, it is understood from the experimental results that the influence of reverberating vibration caused by ejection pulses can be suppressed, and the ejection speeds of ink droplets can be kept approximately equal, by the first and second drive waveform signals including cancel pulses.

As described above, according to the inkjet recording device 1 of this embodiment, the cancel pulse C1, which is included in the first drive waveform signal, having the voltage V3, which is smaller than the voltage V1 of the ejection pulse P1, is applied. Accordingly, the ejection speeds of ink droplets in different pixel periods can be approximately equal because the influence of reverberating vibration is suppressed. Further, the cancel pulse C1 is applied after 2 AL from the finishing time of the ejection pulse P1, so that the cancel pulse C1 acts to generate a negative pressure wave while a positive pressure wave acts by the reverberating vibration; therefore, the cancel pulse C1 can have the same polarity as that of the ejection pulse P1 by which the negative pressure wave acts. This narrows the voltage width in the entire first drive waveform signal.

Further, according to the inkjet recording device 1, the cancel pulse C11, which is included in the second drive waveform signal, has the voltage V2, which is smaller than the voltage V1, with respect to the standby voltage V0. Accordingly, the influence of reverberating vibration caused by the ejection pulse P12 on the ink droplet ejected by the ejection pulse P21 can be suppressed by the cancel pulse C11. This makes the ejection speeds of ink droplets in different pixel periods approximately equal. Further, the cancel pulse C11 is applied from the finishing time of the ejection pulse P12. Accordingly, the cancel pulse C11 can have the same polarity as that of the ejection pulse. This narrows the voltage width in the entire second drive waveform signal. In addition, the influence of reverberating vibration caused by the ejection pulse P11 on the ink droplet ejected by the ejection pulse P12 can be suppressed. This makes the ejection speeds of ink droplets in the same pixel period approximately equal.

Accordingly, the present invention can be defined as an inkjet recording device and a method for generating a drive waveform signal by which, in a case where zero to two ink droplets are ejected in one pixel period, ink droplets within one pixel period and ink droplets in different pixel periods can be ejected at approximately the same ejection speed, and the voltage width of voltages used is widen as less as possible.

In particular, by making the voltage V2 of the cancel pulse C11 larger than the voltage V3 of the cancel pulse C1, the influence of reverberating vibration caused by the ejection pulse P12 on the ink droplet ejected by the ejection pulse P21 can be effectively suppressed by the cancel pulse C11, the influence being larger than that of reverberating vibration caused by the ejection pulse P1 on the ink droplet ejected by the ejection pulse P2. This means that the difference in the ejection speeds of ink droplets in different pixel periods can be made smaller.

[Modification 1]

In the above Embodiment 1, as shown in FIG. 4, when the voltage V3 of the cancel pulse C1 of the first drive waveform signal and the voltage V2 of the cancel pulse C11 of the second drive waveform signal have a relationship V2>V3, which are voltage values different from each other, the reverberating vibration can be more effectively suppressed. In other words, in the first drive waveform signal and the second drive waveform signal, three different voltages (voltages V1 to V3) are included. Accordingly, the drive circuit 200 needs a circuit configuration for applying three voltages to the piezoelectric elements 36, which makes the circuit scale larger.

Figure 11:
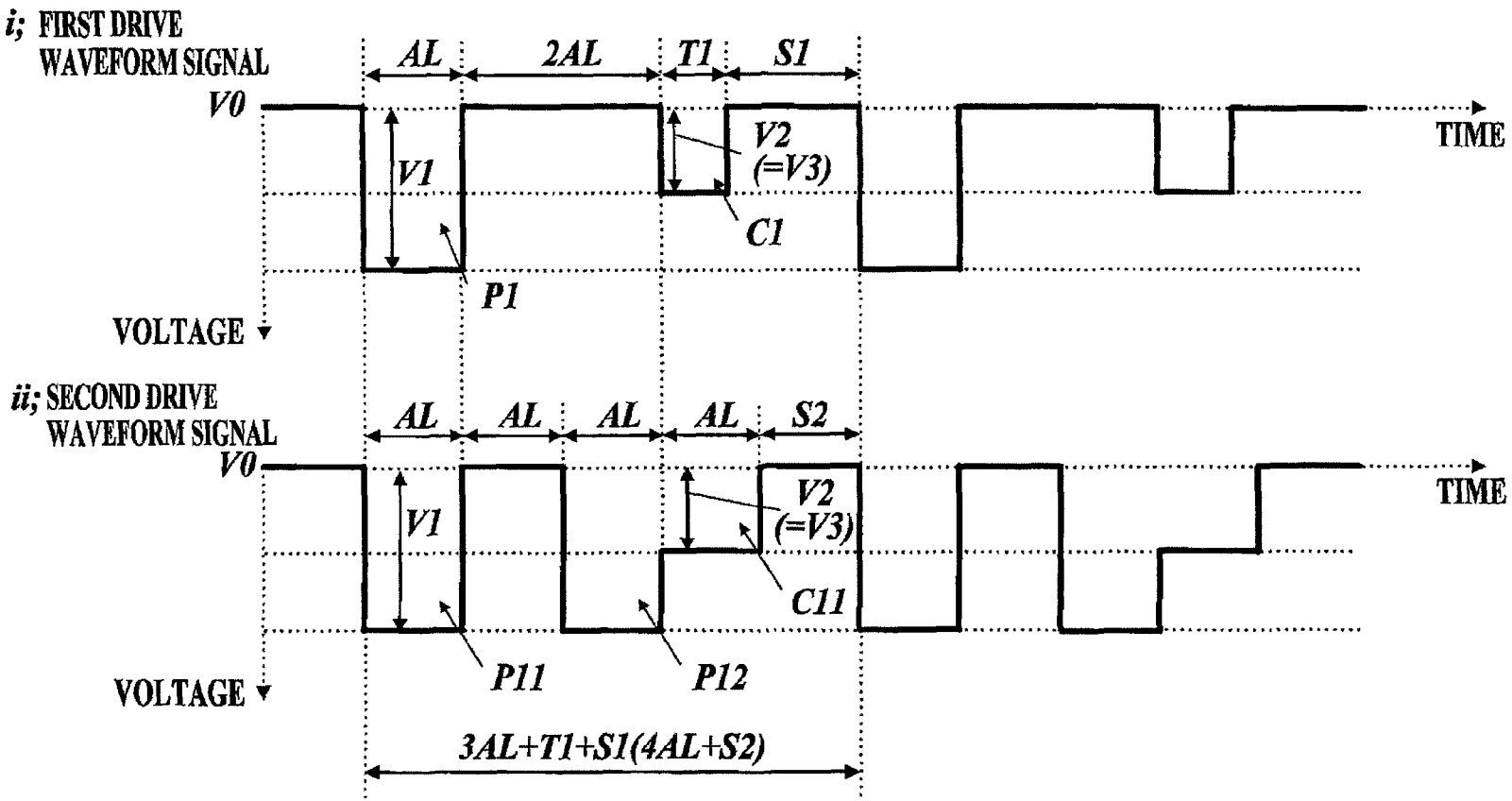
FIG. 11 is a view exemplifying a modification of the drive waveform signals shown in FIG. 4, wherein i; represents a first drive waveform signal, and ii; represents a second drive waveform signal.

In light of the above, in this modification, as shown in FIG. 11, the pulse width of the cancel pulse C1 of the first drive waveform signal is set to T1 which is less than AL. By making the pulse width of the cancel pulse C1 different from AL, the voltage V3 of the cancel pulse C1 of the first drive waveform signal and the voltage V2 of the cancel pulse C11 of the second drive waveform signal can have the same voltage value. In this case, S1 and S2 shown in FIG. 11 are appropriately set such that the pixel period of the first drive waveform signal is equal to the pixel period of the second drive waveform signal. What is necessary here is that the pulse width T1 of the cancel pulse C1 is not equal to AL, and hence the pulse width thereof may be set to be more than AL.

As described above, in this modification, not only the same effect can be exerted as in the case of setting voltage values to V2>V3 in Embodiment 1, but also, because the voltage V3 of the cancel pulse C1 of the first drive waveform signal and the voltage V2 of the cancel pulse C11 of the second drive waveform signal are equal in voltage values, and hence the drive circuit 200 needs a circuit configuration for applying only two voltages V1 and V2 (=V3) to the piezoelectric elements 36, a small circuit scale can be achieved.

The above described embodiment and modification are examples of the preferred inkjet recording device and method for generating a drive waveform signal of the present invention, and hence the present invention is not limited to the above.

Further, various modifications can be made appropriately without departing from the scope of the present invention regarding detailed configurations and operations of the respective components constituting the inkjet recording device of the above embodiment and modification.

INDUSTRIAL APPLICABILITY

The present invention is applicable to the field of image formation performed by an inkjet recording device.

REFERENCE NUMERALS

1 Inkjet recording device
30 Inkjet head part
31 Recording head
34 Pressure chamber
36 Piezoelectric element (pressure generation unit)
39 Nozzle
100 Control unit
120 Head control substrate
200 Drive circuit
P1 Ejection pulse (first ejection pulse)
P11 Ejection pulse (second ejection pulse)
P12 Ejection pulse (third ejection pulse)
C1 Cancel pulse (first cancel pulse)
C11 Cancel pulse (second cancel pulse)

The invention claimed is:

1. An inkjet recording device, comprising:

a recording head which includes a nozzle, a pressure chamber communicating with the nozzle, and a pressure generation unit for applying pressure to ink in the pressure chamber, and ejects an ink droplet from the nozzle by the pressure applied to the ink by the pressure generation unit in response to a drive waveform signal applied to the pressure generation unit; and a drive waveform signal generation unit which generates the drive waveform signal for causing the recording head to eject zero to two ink droplets to one pixel, the drive waveform signal including an ejection pulse for ejecting one ink droplet and a cancel pulse for suppressing influence of reverberating vibration caused by the ejection pulse, wherein when causing the recording head to eject one ink droplet to one pixel, the drive waveform signal generation unit generates a first drive waveform signal which includes, in one pixel period, a first ejection pulse having a pulse width equal to AL which is a half period of a natural oscillation period of the pressure chamber, and a first cancel pulse being applied after 2 AL from finishing time of the first ejection pulse and having the same polarity as the first ejection pulse, and when causing the recording head to eject two ink droplets to one pixel, the drive waveform signal generation unit generates a second drive waveform signal which includes, in one pixel period, a second ejection pulse having a pulse width equal to AL, a third ejection pulse being applied after AL from finishing time of the second ejection pulse and having a pulse width equal to AL, and a second cancel pulse being applied from finishing time of the third ejection pulse and having the same polarity as the third ejection pulse, and a voltage V1 of each of the ejection pulses and a voltage V2 of the second cancel pulse satisfy a relationship V1>V2, and the voltage V1 of each of the ejection pulses and a voltage V3 of the first cancel pulse satisfy a relationship V1>V3.

2. The inkjet recording device according to claim 1, wherein a pulse width of the first cancel pulse is equal to AL, and the voltage V1 of each of the ejection pulses, the voltage V2 of the second cancel pulse and the voltage V3 of the first cancel pulse satisfy a relationship V1>V2>V3.

3. The inkjet recording device according to claim 2, wherein when viscosity of the ink is represented by X, V2/V1 is represented by Y, and V3/V1 is represented by Z, a relationship between X and Y falls within a region surrounded by a curve expressed by a following equation (1) and a curve expressed by a following equation (2), and a relationship between X and Z falls within a region surrounded by a curve expressed by a following equation (3) and a curve expressed by a following equation (4):

$$Y=0.0014X^2-0.055X+0.91 \quad (1);$$

$$Y=-0.0036X^2+0.06X+0.21 \quad (2);$$

$$Z=0.003X^2-0.073X+0.62 \quad (3); \text{ and}$$

$$Z=-0.005X^2+0.097X-0.03 \quad (4).$$

4. The inkjet recording device according to claim 1, wherein a pulse width of the first cancel pulse is not equal to AL, and the voltage V1 of each of the ejection pulses, the voltage V2 of the second cancel pulse and the voltage V3 of the first cancel pulse satisfy a relationship V1>V2=V3.

5. A method for generating a drive waveform signal used in an inkjet recording device including: a recording head which includes a nozzle, a pressure chamber communicating with the nozzle, and a pressure generation unit for applying pressure to ink in the pressure chamber, and ejects an ink droplet from the nozzle by the pressure applied to the ink by the pressure generation unit in response to a drive waveform signal applied to the pressure generation unit; and a drive waveform signal generation unit which generates the drive waveform signal for causing the recording head to eject zero to two ink droplets to one pixel, the drive waveform signal including an ejection pulse for ejecting one ink droplet and a cancel pulse for suppressing influence of reverberating vibration caused by the ejection pulse, the method comprising:

when causing the recording head to eject one ink droplet to one pixel, generating, with the drive waveform signal generation unit, a first drive waveform signal which includes, in one pixel period, a first ejection pulse having a voltage V1 and a pulse width equal to AL which is a half period of a natural oscillation period of the pressure chamber, and a first cancel pulse being applied after 2 AL from finishing time of the first ejection pulse and having the same polarity as the first ejection pulse and a voltage V3 smaller than the voltage V1, and when causing the recording head to eject two ink droplets to one pixel, generating, with the drive waveform signal generation unit, a second drive waveform signal which includes, in one pixel period, a second ejection pulse having a pulse width equal to AL and the voltage V1, a third ejection pulse being applied after AL from finishing time of the second ejection pulse and having a pulse width equal to AL and the voltage V1, and a second cancel pulse being applied from finishing time of the third ejection pulse and having the same polarity as the third ejection pulse and a voltage V2 smaller than the voltage V1.

6. The method for generating the drive waveform signal according to claim 5, wherein a pulse width of the first cancel pulse is equal to AL, and the voltage V1 of each of the ejection pulses, the voltage V2 of the second cancel pulse and the voltage V3 of the first cancel pulse satisfy a relationship V1>V2>V3.

7. The method for generating the drive waveform signal according to claim 6, wherein when viscosity of the ink is represented by X, V2/V1 is represented by Y, and V3/V1 is represented by Z, a relationship between X and Y falls within a region surrounded by a curve expressed by a following equation (1) and a curve expressed by a following equation (2), and a relationship between X and Z falls within a region surrounded by a curve expressed by a following equation (3) and a curve expressed by a following equation (4):

$$Y=0.0014X^2-0.055X+0.91 \quad (1);$$

$$Y=-0.0036X^2+0.06X+0.21 \quad (2);$$

$$Z=0.003X^2-0.073X+0.62 \quad (3); \text{ and}$$

$$Z=-0.005X^2+0.097X-0.03 \quad (4).$$

8. The method for generating the drive waveform signal according to claim 5, wherein a pulse width of the first cancel pulse is not equal to AL, and the voltage V1 of each of the ejection pulses, the voltage V2 of the second cancel pulse and the voltage V3 of the first cancel pulse satisfy a relationship V1>V2=V3.

* * * * *